US007669697B2

(12) United States Patent
Ueda et al.

(10) Patent No.: US 7,669,697 B2
(45) Date of Patent: Mar. 2, 2010

(54) ELEVATOR APPARATUS

(75) Inventors: Takaharu Ueda, Tokyo (JP); Masunori Shibata, Tokyo (JP); Ken-Ichi Okamoto, Tokyo (JP); Satoru Takahashi, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 448 days.

(21) Appl. No.: 11/791,850

(22) PCT Filed: Feb. 1, 2006

(86) PCT No.: PCT/JP2006/301649

§ 371 (c)(1),
(2), (4) Date: May 30, 2007

(87) PCT Pub. No.: WO2007/088599

PCT Pub. Date: Aug. 9, 2007

(65) Prior Publication Data

US 2009/0133964 A1 May 28, 2009

(51) Int. Cl.
*B66B 1/32* (2006.01)
*B66B 1/34* (2006.01)

(52) U.S. Cl. ..... 187/391; 187/351; 187/292

(58) Field of Classification Search ..... 187/277, 187/287, 288, 291–293, 351, 391–393
See application file for complete search history.

(56) References Cited

U.S. PATENT DOCUMENTS 4,478,315 A * 10/1984 Nomura ..... 187/296
4,982,815 A * 1/1991 Arabori et al. ..... 187/288
5,153,389 A * 10/1992 Nomura ..... 187/288
5,244,060 A * 9/1993 Tanaka et al. ..... 187/261
5,402,863 A * 4/1995 Okumura et al. ..... 187/288
5,717,174 A * 2/1998 Ramos ..... 187/288

(Continued)

FOREIGN PATENT DOCUMENTS

JP 7 157 211 6/1995

(Continued)

OTHER PUBLICATIONS

U.S. Appl. No. 11/666,989, filed May 3, 2007, Sakai, et al.

(Continued)

*Primary Examiner*—Walter Benson
*Assistant Examiner*—Eduardo Colon-Santana
(74) *Attorney, Agent, or Firm*—Oblon, Spivak, McClelland, Maier & Neustadt, L.L.P.

(57) ABSTRACT

In an elevator apparatus, a brake control device has a first brake control portion, a second brake control portion, and a third brake control portion. The first brake control portion operates a hoisting machine brake to stop a ascending/descending body as an emergency measure when an abnormality is detected. The second brake control portion reduces a braking force of the hoisting machine brake when a deceleration of the ascending/descending body becomes equal to or higher than a predetermined value during an emergency braking operation of the hoisting machine brake. The third brake control portion monitors a slip speed of a main rope with respect to a drive sheave during emergency braking operation of the hoisting machine brake, and reduces a braking force of the hoisting machine brake when the slip speed of the main rope becomes equal to or higher than a predetermined value.

7 Claims, 6 Drawing Sheets

U.S. PATENT DOCUMENTS

| | | | | |
|---|---|---|---|---|
| 6,092,630 | A * | 7/2000 | Wendel et al. | 187/373 |
| 7,080,717 | B2 * | 7/2006 | Ito | 187/350 |
| 7,228,943 | B2 * | 6/2007 | Kugiya et al. | 187/393 |
| 2006/0180406 | A1 * | 8/2006 | Gremaud et al. | 187/355 |
| 2009/0229924 | A1 * | 9/2009 | Kondo et al. | 187/288 |

FOREIGN PATENT DOCUMENTS

| | | |
|---|---|---|
| JP | 08040662 | 2/1996 |
| JP | 8 333058 | 12/1996 |
| JP | 2004 231 355 | 8/2004 |
| WO | 2004 083091 | 9/2004 |

OTHER PUBLICATIONS

U.S. Appl. No. 11/791,470, filed May 24, 2007, Takahashi, et al.
U.S. Appl. No. 11/794,198, filed Jun. 26, 2007, Okamoto, et al.
U.S. Appl. No. 11/794,321, filed Jun. 28, 2007, Shibata, et al.
U.S. Appl. No. 11/794,823, filed Jul. 6, 2007, Ueda, et al.
U.S. Appl. No. 12/064,394, filed Feb. 21, 2008, Ueda, et al.

* cited by examiner

ELEVATOR APPARATUS

TECHNICAL FIELD

The present invention relates to an elevator apparatus having a brake control device for controlling a hoisting machine brake.

BACKGROUND ART

In a conventional brake device for an elevator, a braking force of an electromagnetic brake is controlled during emergency braking such that a deceleration of a car becomes equal to a predetermined value, based on a deceleration command value and a speed signal (e.g., see Patent Document 1).

In a conventional braking control device for an elevator, a braking force smaller than a total braking force is applied when a rope slip speed calculated as a difference between a sheave speed and a car speed becomes equal to or higher than a predetermined value during emergency braking (e.g., see Patent Document 2).

Patent Document 1: JP 07-157211 A

Patent Document 2: JP 2004-231355 A

DISCLOSURE OF THE INVENTION

Problem to be Solved by the Invention

In each of the conventional brake device and the conventional braking control device as described above, however, a basic operation of emergency braking and control of the braking force are both performed by a single braking force control unit, so it takes a long time to perform calculations for braking force control. As a result, there is a delay in generating the braking force.

The present invention has been made to solve the above-mentioned problem, and it is therefore an object of the present invention to obtain an elevator apparatus capable of starting an operation of emergency braking more reliably and swiftly while suppressing a deceleration during emergency braking and restraining a main rope from slipping.

Means for Solving the Problem

An elevator apparatus according to the present invention includes: a hoisting machine having a drive sheave and a hoisting machine brake for braking rotation of the drive sheave; a main rope wound around the drive sheave; a ascending/descending body suspended by the main rope to be raised and lowered by the hoisting machine; and a brake control device for controlling the hoisting machine brake, in which: the brake control device has: a first brake control portion for stopping the ascending/descending body as an emergency measure by operating the hoisting machine brake when an abnormality is detected; a second brake control portion for reducing a braking force of the hoisting machine brake when a deceleration of the ascending/descending body becomes equal to or higher than a predetermined value during emergency braking operation of the hoisting machine brake; and a third brake control portion for monitoring a slip speed of the main rope with respect to the drive sheave during emergency braking operation of the hoisting machine brake and reducing a braking force of the hoisting machine brake when the slip speed of the main rope becomes equal to or higher than a predetermined value; and the second brake control portion and the third brake control portion control the hoisting machine brake independently of the first brake control portion.

BEST MODE FOR CARRYING OUT THE INVENTION

A preferred embodiment of the present invention will be described hereinafter with reference to the drawings.

EMBODIMENT 1

Figure 1:
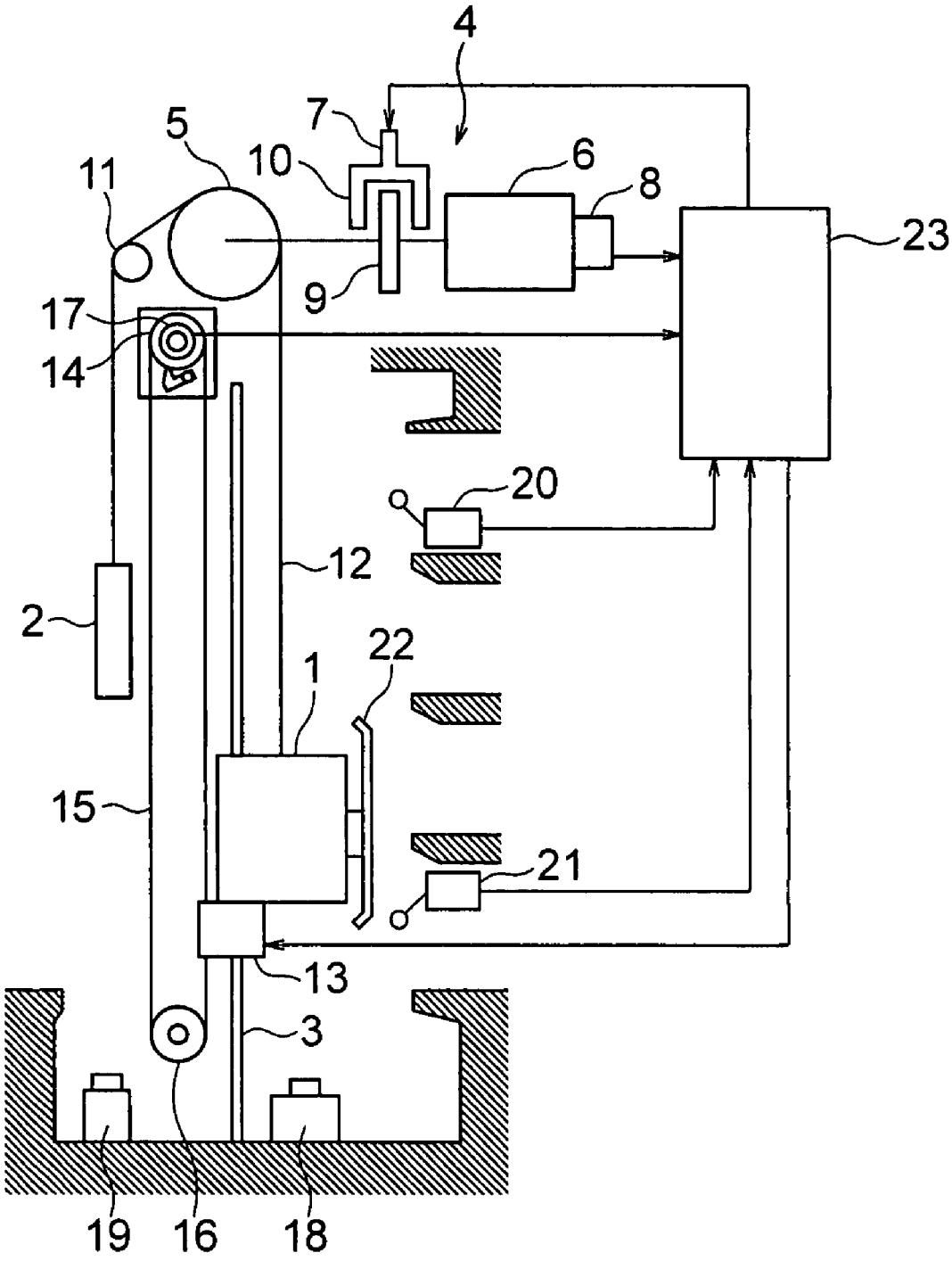
FIG. 1 is a schematic diagram showing an elevator apparatus according to Embodiment 1 of the present invention.

FIG. 1 is a schematic diagram showing an elevator apparatus according to Embodiment 1 of the present invention. A car 1 and a counterweight 2 as elevating bodies are raised/lowered within a hoistway. A car guide rail 3 for guiding the raising/lowering of the car 1 and a counterweight guide rail (not shown) for guiding the raising/lowering of the counterweight 2 are installed within the hoistway.

A hoisting machine 4 for raising/lowering the car 1 and the counterweight 2 is installed in an upper portion of the hoistway. The hoisting machine 4 has a drive sheave 5, a motor 6 for rotating the drive sheave 5, a hoisting machine brake 7 for braking rotation of the drive sheave 5, and a sheave speed detector 8 for detecting a rotational speed of the drive sheave 5 (a rotational speed of a rotating shaft of the motor 6). Employed as the sheave speed detector 8 is, for example, a motor encoder for generating a pulse signal corresponding to a rotational speed of the rotating shaft of the motor 6.

The hoisting machine brake 7 has a brake rotational body 9 such as a brake drum which is rotated integrally with the rotating shaft of the motor 6 and the drive sheave 5, a brake shoe 10 that is brought into contact with and moved away from the brake rotational body 9, a brake spring (not shown) for pressing the brake shoe 10 against the brake rotational body 9, and an electromagnet (not shown) for moving the brake shoe 10 away from the brake rotational body 9 against the brake spring.

A deflector pulley 11 is disposed in the vicinity of the drive sheave 5. A plurality of main ropes 12 (only one of the main ropes 12 is illustrated in FIG. 1) are wound around the drive sheave 5 and the deflector pulley 11. The car 1 and the counterweight 2 are suspended within the hoistway by means of the main ropes 12. The car 1 and the counterweight 2 are raised/lowered within the hoistway via the main ropes 12 by the hoisting machine 4.

A safety device (car brake) 13, which engages with the car guide rail 3, for stopping the car 1 is mounted on a lower portion of the car 1. A speed governor 14 is installed in the upper portion of the hoistway. The speed governor 14 is provided with a speed governor sheave, an overspeed detecting switch, a rope catch, and the like. A speed governor rope 15 is wound around the speed governor sheave. The speed governor rope 15 is connected at both ends thereof to an operating mechanism of the safety device 13. The lower end of the speed governor rope 15 is wound around a tension pulley 16 disposed in a lower portion of the hoistway.

When the car 1 is raised/lowered, the speed governor rope 15 is circulated, so the speed governor sheave is rotated at a rotational speed corresponding to a running speed of the car 1. It is mechanically detected in the speed governor 14 that a running speed of the car 1 has reached an overspeed. A first overspeed higher than a rated speed and a second overspeed higher than the first overspeed are set as the overspeeds to be detected.

When the running speed of the car 1 reaches the first overspeed, the overspeed detecting switch of the speed governor 14 is operated. When the overspeed detecting switch is operated, the supply of power to the motor 6 is shut off, and the rotation of the drive sheave 5 is braked by the hoisting machine brake 7, so the car 1 is stopped. When the running speed of the car 1 reaches the second overspeed, the speed governor rope 15 is gripped by the rope catch of the speed governor 14, so the circulation of the speed governor rope 15 is stopped. When the circulation of the speed governor rope 15 is stopped, the safety device 13 is operated to perform a braking operation.

The speed governor 14 is provided with a car speed detector 17 as a ascending/descending body speed detector for generating a signal corresponding to a rotational speed of the speed governor sheave, namely, a running speed of the car 1. Employed as the car speed detector 17 is, for example, a governor encoder for generating a pulse signal corresponding to a rotational speed of the speed governor sheave.

A car shock absorber 18 and a counterweight shock absorber 19 are installed in the lower portion (pit) within the hoistway. The car shock absorber 18, which is disposed directly below the car 1, absorbs a shock caused upon a collision of the car 1 with a bottom of the hoist way. The counterweight shock absorber 19, which is disposed directly below the counterweight 2, absorbs a shock caused upon a collision of the counterweight 2 with the bottom of the hoistway.

An upper terminal detection switch 20 is installed in the vicinity of an upper terminal floor within the hoistway. A lower terminal detection switch 21 is installed in the vicinity of a lower terminal floor within the hoistway. The car 1 is mounted with an operating member 22 for operating the terminal detection switches 20 and 21.

The hoisting machine brake 7 is controlled by a brake control device 23. Signals from the sheave speed detector 8, the car speed detector 17, and the terminal detection switches 20 and 21 are input to the brake control device 23.

Figure 2:
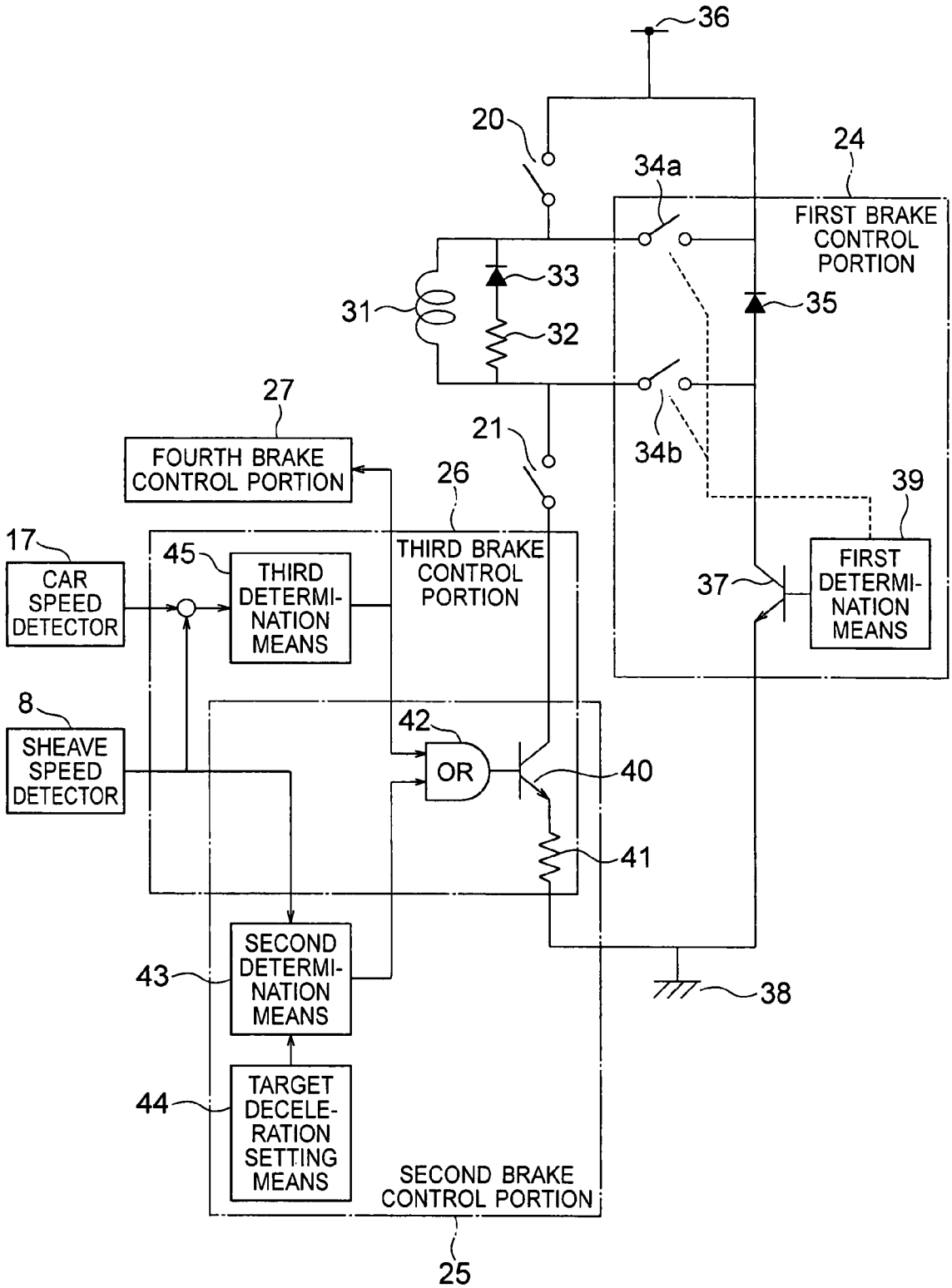
FIG. 2 is a circuit diagram showing a brake control device of FIG. 1.

FIG. 2 is a circuit diagram showing the brake control device 23 of FIG. 1. The brake control device 23 has a first brake control portion 24, a second brake control portion 25, a third brake control portion 26, and a fourth brake control portion 27. The first brake control portion 24, the second brake control portion 25, and the third brake control portion 26 control the hoisting machine brake 7 independently of one another. The fourth brake control portion 27 controls braking operation time of the safety device 13.

The electromagnet of the hoisting machine brake 7 is provided with a brake coil (electromagnetic coil) 31. The brake coil 31 is energized to excite the electromagnet, so the brake shoe 10 is moved away from the brake rotational body 9. A current value of the brake coil 31 is controlled to control a degree of opening of the hoisting machine brake 7.

A circuit having a discharge resistor 32 and a first discharge diode 33 that are connected in series to each other is connected in parallel to the brake coil 31. A second discharge diode 35 is connected in parallel to both ends of the brake coil 31 via a first electromagnetic relay 34*a* and a second electromagnetic relay 34*b*. Further, the brake coil 31 is connected on the first relay 34*a* side thereof to a power supply 36. Still further, the brake coil 31 is connected on the second relay 34*b* side thereof to a ground 38 for the power supply 36 via a first semiconductor switch 37.

The turning ON/OFF of the first semiconductor switch 37 is controlled by first determination means 39. In raising/lowering the car 1, the first determination means 39 turns the first semiconductor switch 37 ON to energize the brake coil 31, thereby canceling a braking force of the hoisting machine brake 7. In stopping the car 1, the first determination means 39 turns the first semiconductor switch 37 OFF to deenergize the brake coil 31, thereby causing the hoisting machine brake 7 to generate a braking force (maintaining a stationary state).

In addition, when some abnormality is detected in the elevator apparatus, the first determination means 39 turns the first semiconductor switch 37 OFF and opens the electromagnetic relays 34*a* and 34*b* to deenergize the brake coil 31, thereby causing the hoisting machine brake 7 to perform braking operation. Thus, the car 1 is stopped as an emergency measure.

The function of the first determination means 39 is realized by, for example, a first computer (not shown) of an elevator control device for controlling the travel of the car 1. In other words, a program for realizing the function of the first determination means 39 is stored in the first computer.

The first brake control portion (main control portion) 24 has the electromagnetic relays 34*a* and 34*b*, the second discharge diode 35, the first semiconductor switch 37, and the first determination means 39. The first brake control portion 24 also includes a safety circuit (not shown) for opening the electromagnetic relays 34*a* and 34*b* in response to the occurrence of an abnormality in the elevator apparatus.

The brake coil 31 is connected on the first relay 34*a* side thereof to the power supply 36 via the upper terminal detection switch 20. The brake coil 31 is connected on the second relay 34*b* side thereof to the ground 38 via the lower terminal detection switch 21, a second semiconductor switch 40, and a current limiting resistor 41. The current limiting resistor 41 limits the amount of a current flowing through the brake coil 31.

Each of the terminal detection switches 20 and 21 is opened when the car 1 is located at a corresponding one of the terminal floors while being operated by the operating member 22. Otherwise, the terminal detection switches 20 and 21 are closed. Accordingly, when the second semiconductor switch 40 is turned ON with the car 1 not being located in the vicinity of any one of the terminal floors, the brake coil 31 is excited even if the electromagnetic relays 34*a* and 34*b* and the first semiconductor switch 37 are OFF. At this moment, the amount of the current flowing through the brake coil 31 is limited by the current limiting resistor 41. Therefore, an electromagnetic force generated in the brake coil 31 is smaller at this moment than when a brake is released by the first brake control portion 24.

The turning ON/OFF of the second semiconductor switch 40 is controlled by OR logic means 42. A signal from second determination means 43 is input to one side of the OR logic means 42. An output signal from the sheave speed detector 8 is input to the second determination means 43. The second determination means 43 calculates a car speed (sheave speed to be exact) based on the signal from the sheave speed detector 8, and differentiates the car speed to calculate a car deceleration (the absolute value of a negative overspeed).

A target deceleration (threshold) set by target deceleration setting means 44 is input to the second determination means 43. The second determination means 43 then compares the car deceleration calculated based on the signal from the sheave speed detector 8 with the target deceleration, and outputs an ON signal to the OR logic means 42 when the car deceleration reaches the target deceleration. That is, when the car deceleration becomes equal to or higher than a predetermined value, the second determination means 43 turns the second semiconductor switch 40 ON to energize the brake coil 31, thereby reducing a braking force of the hoisting machine brake 7.

The second brake control portion (deceleration suppressing portion) 25 has the second semiconductor switch 40, the current limiting resistor 41, the OR logic means 42, the second determination means 43, and the target deceleration setting means 44. The functions of the OR logic means 42, the second determination means 43, and the target deceleration setting means 44 are realized by, for example, a second computer (not shown) that is different from the first determination means 39. In other words, programs for realizing the functions of the OR logic means 42, the second determination means 43, and the target deceleration setting means 44 are stored in the second computer.

A signal from third determination means 45 is input to the other side of the OR logic means 42. A differential signal as a difference between an output signal from the car speed detector 17 and an output signal from the sheave speed detector 8 is input to the third determination means 45. The third determination means 45 then detects a slip speed of the main ropes 12 with respect to the drive sheave 5, and outputs an ON signal to the OR logic means 42 when the slip speed reaches a preset value (threshold). That is, when the slip speed of the main ropes 12 becomes equal to or higher than a predetermined value, the third determination means 45 turns the second semiconductor switch 40 ON to energize the brake coil 31, thereby reducing a braking force of the hoisting machine brake 7.

The third brake control portion (slip restraining portion) 26 has the second semiconductor switch 40, the current limiting resistor 41, the OR logic means 42, and the third determination means 45. The function of the third determination means 45 is realized by, for example, the second computer, which is common to the second determination means 43. In other words, a program for realizing the function of the third determination means 45 is stored in the second computer.

The ON signal that is output from the third determination means 45 when the slip speed reaches the predetermined value is also input to the fourth brake control portion 27. When the ON signal is input from the third determination means 45 to the fourth brake control portion 27, the fourth brake control portion 27 outputs a command signal for reducing a braking operation time to the safety device 13. The function of the fourth brake control portion (safety control portion) 27 is also realized by, for example, the second computer.

Figure 3:
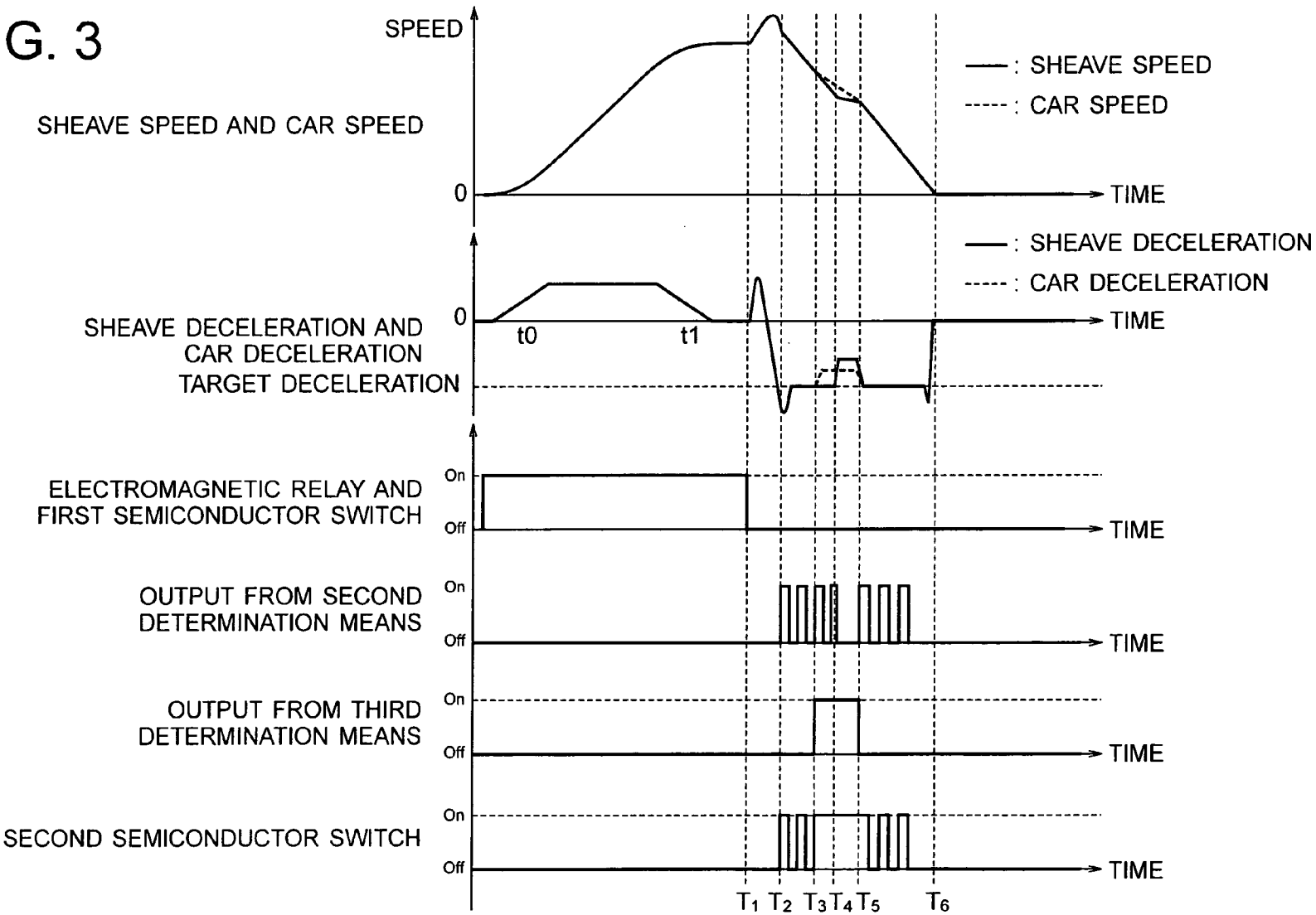
FIG. 3 is a timing chart for explaining operations of a second brake control portion and a third brake control portion of FIG. 2.

Reference will be made next to FIG. 3. FIG. 3 is a timing chart for explaining the operations of the second brake control portion 25 of FIG. 2 and the third brake control portion 26 of FIG. 2. In stopping the car 1 as an emergency measure, the first brake control portion 24 turns the electromagnetic relays 34*a* and 34*b* and the first semiconductor switch 37 OFF (at time T1). At this moment, the torque of the motor 6 has become null, so the drive sheave 5 and the car 1 temporarily accelerate or decelerate in accordance with a difference in weight between the car 1 and the counterweight 2, and then start decelerating through application of a braking force of the hoisting machine brake 7 to the drive sheave 5 (from time T1 to time T2).

The second brake control portion 25 monitors the deceleration of the drive sheave 5 while the drive sheave 5 and the car 1 are decelerating. Then, when the deceleration of the drive sheave 5 becomes equal to or higher than a target deceleration, the second semiconductor switch 40 is turned ON. When the deceleration of the drive sheave 5 becomes lower than the target deceleration, the second semiconductor switch 40 is turned OFF (from time T2 to time T3). Referring to FIG. 3, within a short period of time between a time T2 and a time T3, the second semiconductor switch 40 is repeatedly turned ON/OFF to control (perform chopping control of) the deceleration of the drive sheave 5.

During deceleration of the drive sheave 5 and the car 1, the third brake control portion 26 monitors the slip speed of the main ropes 12 with respect to the drive sheave 5. Then, when the slip speed exceeds a predetermined value, the second semiconductor switch 40 is turned ON (at time T3). Thus, the slip speed of the main ropes 12 decreases (from time T4 to time T5), and the output from the third determination means 45 becomes OFF (at time T5). After that as well, the second brake control portion 25 and the third brake control portion 26 continue to perform monitoring until the drive sheave 5 and the car 1 are stopped (from time T5 to time T6).

However, when the car 1 reaches the vicinity of one of the terminal floors during deceleration thereof and a corresponding one of the terminal detection switches 20 and 21 is operated, the control performed by the second brake control portion 25 and the third brake control portion 26 is invalidated and the car 1 is stopped immediately.

Figure 4:
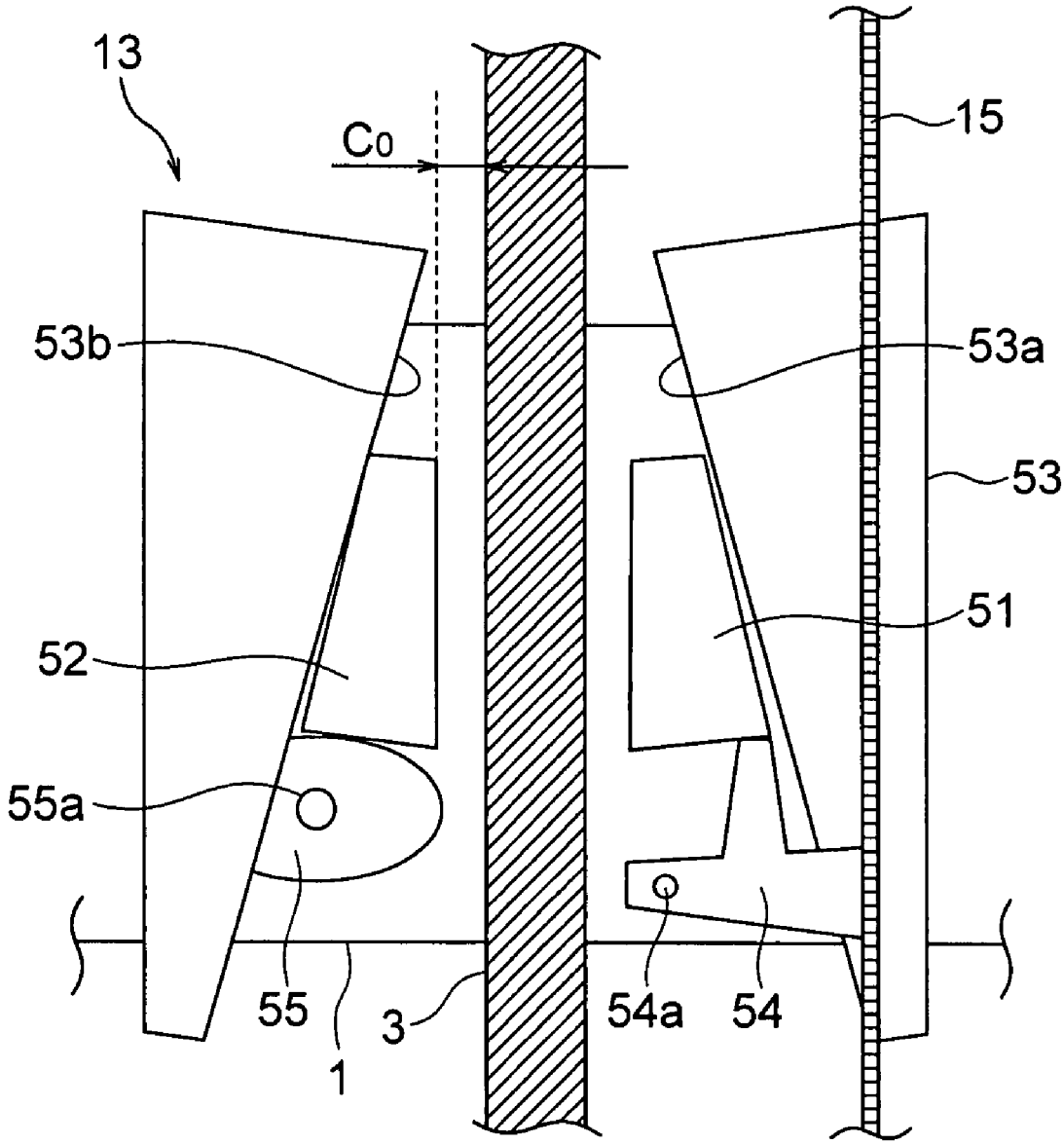
FIG. 4 is a schematic diagram showing a safety device of FIG. 1.

Reference will be made next to FIG. 4. FIG. 4 is a schematic diagram showing the safety device 13 of FIG. 1. The safety device has a first braking member (wedge member) 51 disposed on one side of the car guide rail 3, a second braking member (wedge member) disposed on the other side of the car guide rail 3, a guide body for guiding displacement of the braking members 51 and 52, an actuating strip 54 for causing the first braking member 51 to perform braking operation, and an elliptical cam plate 55 for displacing the second braking member 52.

The actuating strip 54 is connected to the speed governor rope 15. When the speed at which the car 1 is lowered reaches the second overspeed and the speed governor rope 15 is stopped from being circulated, the car 1 continues to be lowered, so the actuating strip 54 is turned around a shaft 54*a* counterclockwise in FIG. 4. Thus, the first braking member 51 is displaced upward with respect to the car 1.

The guide body 53 is provided with a first guide surface 53*a* and a second guide surface 53*b* that are opposed to each other. The clearance between the guide surfaces 53*a* and 53*b* narrows upward. Accordingly, when being pushed up by the actuating strip 54, the first braking member 51 approaches the car guide rail 3 and eventually is wedged into a gap between the first guide surface 53*a* and a first lateral surface of the car guide rail 3. Thus, the car 1 is displaced slightly rightward in FIG. 4, so the car guide rail 3 is sandwiched between the first braking member 51 and the second braking member 52. As a result, the car 1 is braked through friction.

Figure 5:
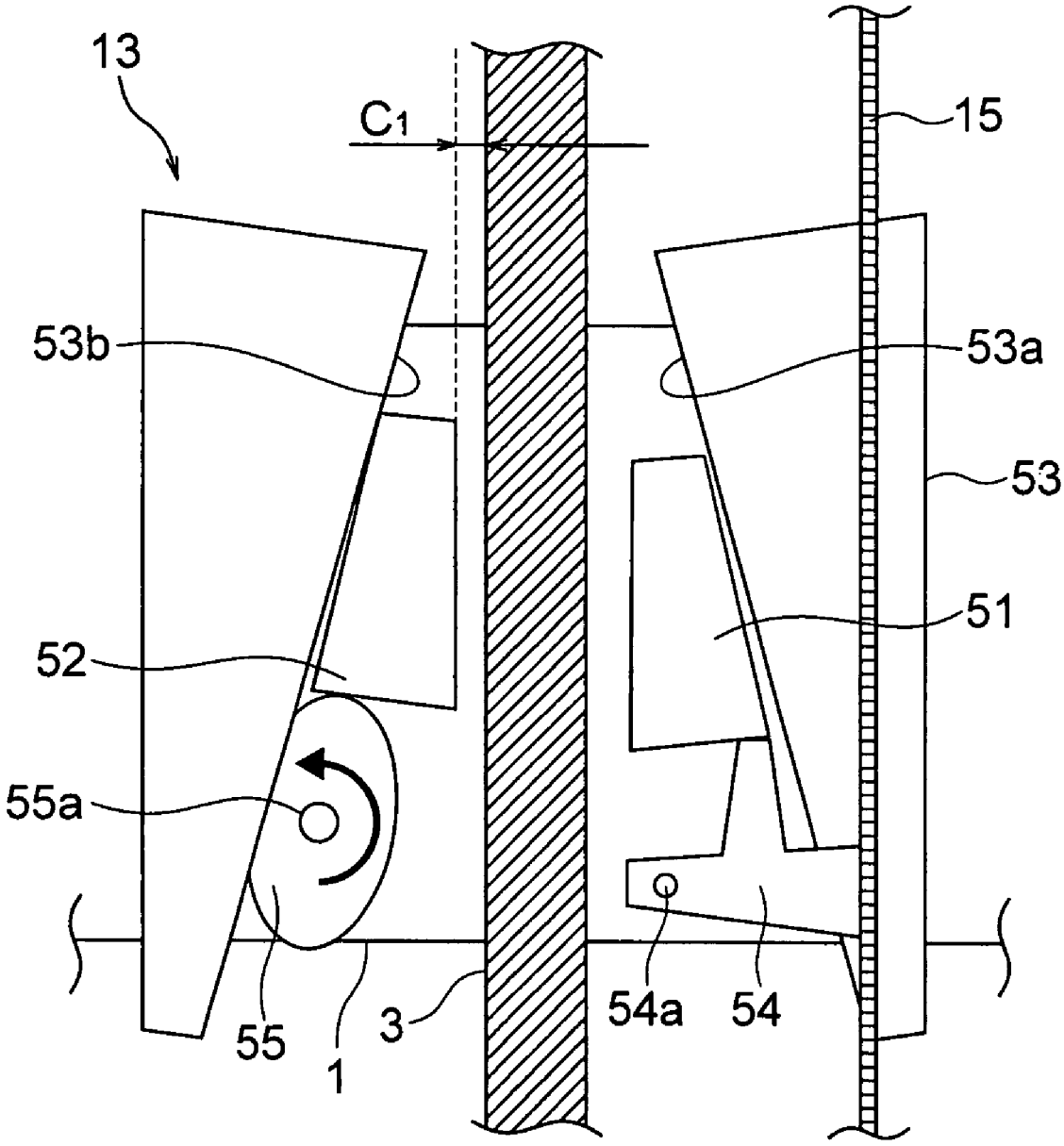
FIG. 5 is a schematic diagram showing a state where a cam plate of FIG. 4 has been turned.

In response to a command signal from the fourth brake control portion 27, the cam plate 55 is turned around a shaft 55*a* by about 90° from a state of FIG. 4 to a state of FIG. 5. Thus, the second braking member 52 is displaced upward with respect to the car 1, so the clearance (clearance before the start of braking operation) between the second braking member 52 and a second lateral surface of the car guide rail 3 is narrowed from C0 to C1 as shown in FIGS. 4 and 5 (C0>C1). As a result, the braking operation time of the safety device 13, namely, the time from a moment when the speed governor rope 15 is stopped from being circulated to a moment when a braking force is generated is shortened. The cam plate 55 is turned by, for example, a servomotor (not shown) provided on the car 1.

In the elevator apparatus constructed as described above, the operation of emergency braking can be started more reliably and swiftly while suppressing a deceleration during emergency braking and restraining the main ropes 12 from slipping. That is, the deceleration during emergency braking is suppressed by the second brake control portion 25, so an improvement in riding comfort during emergency braking can be made. The main ropes 12 are restrained from slipping by the third brake control portion 26 during emergency braking, so the stopping distance of the car 1 can be shortened and the vertical dimension of the hoistway can be reduced. In addition, the speed of the car 1 is monitored by the speed governor 14, so the car 1 can be stopped more reliably even when the main ropes 12 slip excessively.

When the slip speed of the main ropes 12 becomes equal to or higher than the predetermined value, the fourth brake control portion 27 outputs a command signal for reducing the braking operation time of the safety device 13. As a result, the stopping distance of the car 1 can be shortened more reliably.

Further, the safety device 13 is provided with the cam plate 55 that is turned in response to a command signal from the fourth brake control portion 27 to displace the braking member 52. Therefore, the braking operation time of the safety device 13 can be changed with a simple structure.

In addition, the second semiconductor switch 40, which is controlled by the second brake control portion 25 and the third brake control portion 26, has a power supply system other than that of the first semiconductor switch 37, which is controlled by the first brake control portion 24. Also, the current limiting resistor 41 is connected in series to the second semiconductor switch 40. Therefore, the amount of the current flowing through the brake coil 31 can be limited appropriately, and the amount of the control of the hoisting machine brake 7 by the second brake control portion 25 and the third brake control portion 26 can be set appropriately.

The control performed by the second brake control portion 25 and the third brake control portion 26 is invalidated when the car 1 reaches the vicinity of one of the terminal floors during emergency braking operation of the hoisting machine brake 7. Therefore, the car 1 can be stopped more reliably in the vicinity of any one of the terminal floors.

The second determination means 43 may calculate a car deceleration based not on a signal from the sheave speed detector 8 but on a signal from the car speed detector 17.

In the foregoing example, the car speed detector 17 is provided on the speed governor 14. However, a deflector pulley rotation detector 70 for generating a signal corresponding to a rotational speed of the deflector pulley 11 may be employed as a car speed detector as shown in, for example, FIG. 6.

Figure 6:
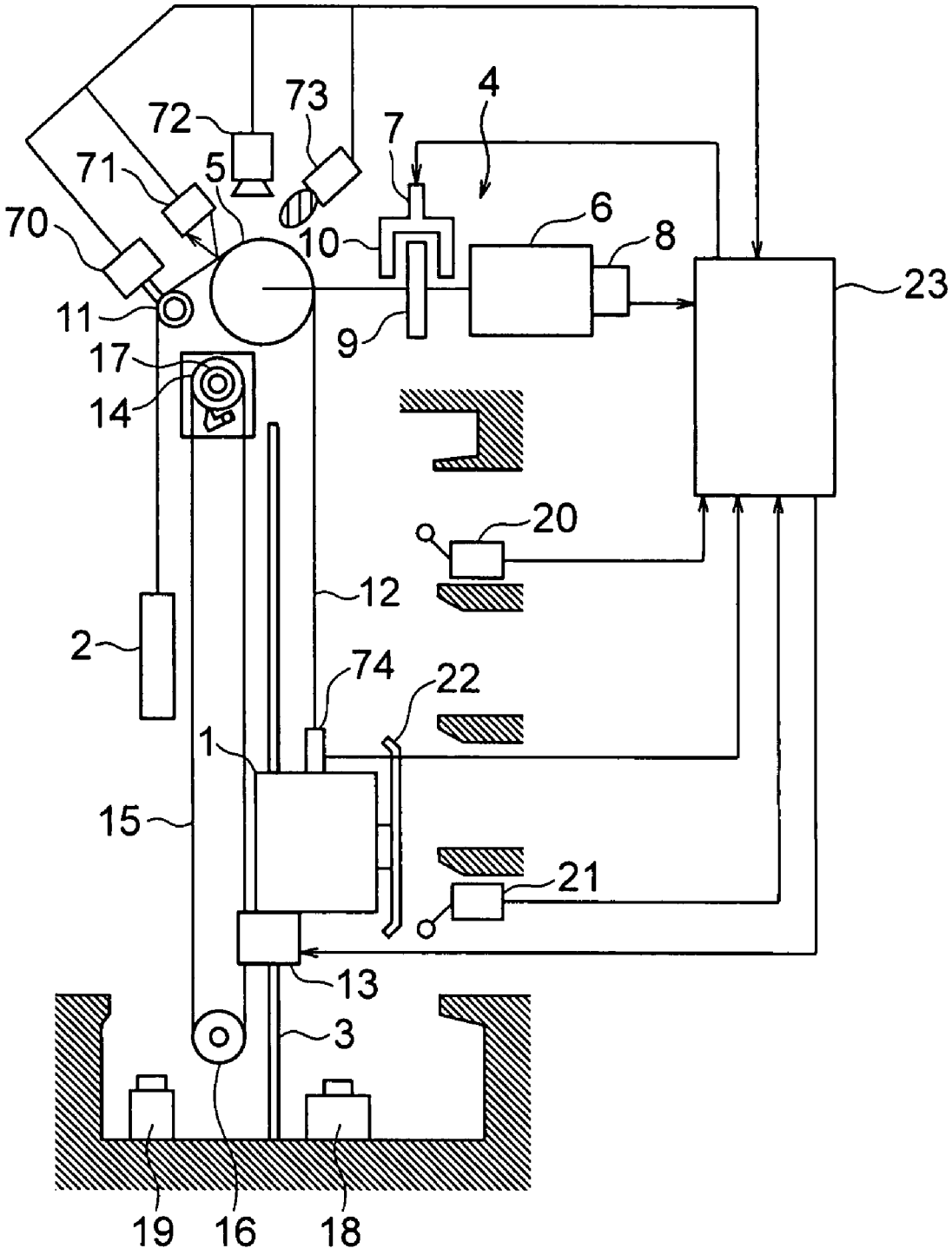
FIG. 6 is a schematic diagram showing a plurality of modified examples of a method of detecting a car speed and a slip speed.

Further, a main rope speed detector 71 for generating a signal corresponding to a speed of the main ropes 12 may be employed as a car speed detector as shown in, for example, FIG. 6. A measuring device for measuring a moving speed of the main ropes 12 from a speckle pattern obtained by photographing diffusely reflected beams, which are generated by irradiating surfaces of the main ropes 12 with laser beams, by means of a special camera can be employed as the main rope speed detector 71.

Further, a camera device 73 for photographing the main ropes 12 may be employed as a car speed detector as shown in, for example, FIG. 6.

By providing the car speed detector in addition to the speed governor 14 as described above, the accuracy in detecting a car speed can be improved irrespective of the flexibility (rigidity) of the speed governor rope 15.

Further, in the foregoing example, the slip speed of the main ropes 12 is calculated from the difference between the sheave speed and the car speed. However, the slip speed may be estimated from a signal from a microphone device 73 for detecting a slip sound of the main ropes 12 as shown in, for example, FIG. 6.

The slip speed may also be estimated from a signal from a temperature sensor (not shown) for detecting a rise in the temperature of the drive sheave 5 resulting from a slip of the main ropes 12.

Moreover, the slip speed may also be estimated from a signal from a tensile force detecting device 74 for detecting changes in the tensile forces of the main ropes 12 resulting from a slip thereof as shown in, for example, FIG. 6.

FIG. 6 shows a state in which a plurality of car speed detectors and a plurality of slip speed detectors are installed all together. As a matter of course, however, it is appropriate to selectively install one of the car speed detectors and one of the slip speed detectors.

Further, although the car 1 is mounted with the safety device 13 in the foregoing example, the present invention is also applicable to a case where the counterweight 2 is mounted with the safety device 13.

Further, although the safety device 13 illustrated in the foregoing example is designed to operate when the car 1 is running downward, the present invention is also applicable to a case where a safety device designed to operate when the car 1 is running upward is employed.

Further, although the computer constituting the first determination means 39 and the computer constituting the second determination means 43 and the third determination means 45 are separate from each other in the foregoing example, the first determination means 39, the second determination means 43, and the third determination means 45 may be constituted by a common computer. The second determination means 43 and the third determination means 45 may also be constituted by separate computers.

Further, the functions of the first determination means 39, the second determination means 43, and the third determination means 45 can also be realized by a logic circuit for processing analog signals.

Although the hoisting machine 4 is disposed in the upper portion of the hoistway in the foregoing example, it is also appropriate to dispose the hoisting machine 4 somewhere else, for example, in the lower portion of the hoistway.

Further, the main ropes 12 should not be specifically limited in roping arrangement and may adopt, for example, a 2:1 roping arrangement.

Still further, the main ropes 12 may have a circular cross-section or a belt shape.

Further, the hoisting machine brake 7 may be designed to be mounted inside the drive sheave 5 or inside a rotor of the motor 6.

The invention claimed is:

1. An elevator apparatus, comprising:

a hoisting machine having a drive sheave and a hoisting machine brake for braking rotation of the drive sheave;

a main rope wound around the drive sheave;

a ascending/descending body suspended by the main rope to be raised and lowered by the hoisting machine; and a brake control device for controlling the hoisting machine brake, wherein:

the brake control device has:

a first brake control portion for stopping the ascending/descending body as an emergency measure by operating the hoisting machine brake when an abnormality is detected;

a second brake control portion for reducing a braking force of the hoisting machine brake when a deceleration of the ascending/descending body becomes equal to or higher than a predetermined value during emergency braking operation of the hoisting machine brake; and a third brake control portion for monitoring a slip speed of the main rope with respect to the drive sheave during emergency braking operation of the hoisting machine brake and reducing a braking force of the hoisting machine brake when the slip speed of the main rope becomes equal to or higher than a predetermined value; and the second brake control portion and the third brake control portion control the hoisting machine brake independently of the first brake control portion.

2. The elevator apparatus according to claim 1, further comprising:

a guide rail for guiding raising and lowering of the ascending/descending body; and a safety device mounted on the ascending/descending body, which engages with the guide rail, for braking the ascending/descending body when a speed of the ascending/descending body reaches a preset overspeed, wherein the brake control device further has a fourth brake control portion for outputting a command signal for reducing a braking operation time of the safety device when the slip speed of the main rope becomes equal to or higher than the predetermined value.

3. The elevator apparatus according to claim 2, wherein:

the safety device is provided with a braking member that is pressed against the guide rail during a braking operation; and the braking member and the guide rail are spaced apart from each other, before start of braking operation, by a clearance that is narrowed when the command signal from the fourth brake control portion is input to the safety device.

4. The elevator apparatus according to claim 1, wherein the third brake control portion calculates the slip speed of the main rope based on a signal from a sheave speed detector for detecting a rotational speed of the drive sheave and a signal from a ascending/descending body speed detector for detecting a speed of the ascending/descending body.

5. The elevator apparatus according to claim 1, wherein:

the hoisting machine brake has a brake coil for generating an electromagnetic force for canceling the braking force; and the second brake control portion and the third brake control portion have a switch for energizing and deenergizing the brake coil independently of the first brake control portion.

6. The elevator apparatus according to claim 5, wherein the switch has connected thereto a current limiting resistor for limiting an amount of a current flowing through the brake coil.

7. The elevator apparatus according to claim 1, wherein the second brake control portion and the third brake control portion perform control that is invalidated when the ascending/descending body reaches a vicinity of a terminal floor during an emergency braking operation of the hoisting machine brake.

* * * * *